United States Patent [19]

Boudrias

[11] Patent Number: 4,938,629

[45] Date of Patent: Jul. 3, 1990

[54] FLOATABLE AND SINKABLE WHARF STRUCTURE

[76] Inventor: Philippe C. Boudrias, 268, Amédée-Meunier, Repentigny, Quebec, Canada, J6A 1H9

[21] Appl. No.: 330,684

[22] Filed: Mar. 30, 1989

[51] Int. Cl.[5] ..... E02B 3/20

[52] U.S. Cl. ..... 405/205; 405/219; 114/263

[58] Field of Search ..... 405/205, 207, 209, 218, 405/219, 220, 221; 114/263, 264, 266, 267

[56] References Cited

U.S. PATENT DOCUMENTS

| | | | |
|---|---|---|---|
| 3,009,326 | 11/1961 | Williams | 405/219 |
| 3,054,267 | 9/1962 | Alcorn et al. | 405/209 |
| 4,441,449 | 4/1984 | Biaggi | 114/263 |
| 4,543,903 | 10/1985 | Kramer | 114/263 |
| 4,642,000 | 2/1987 | Lin | 405/221 |

*Primary Examiner*—Dennis L. Taylor
*Assistant Examiner*—J. Russell McBee
*Attorney, Agent, or Firm*—Roland L. Morneau

[57] ABSTRACT

A floatable and sinkable concrete modular structure for making a wharf. The wharf is made of adjacent hollow shells in which water can be introduced or withdrawn by a low air pressure blower. The shells are fluidly interconnected by a piping system between the bottom of one shell with the upper part of the adjacent shell for progressingly tilting the wharf.

9 Claims, 5 Drawing Sheets

FLOATABLE AND SINKABLE WHARF STRUCTURE

BACKGROUND OF THE INVENTION

1. Field of the Invention

The invention relates to floating concrete wharf structure having on airtight inner chamber and a piping system adapted to sink and re-float the wharf.

2. Prior Art

Floatable concrete structures are well known. U.S. Pat. No 3,977,344 describes a floating duct which is intended to remain at a constant height relative to the water line. The duct is made of a plurality of adjacent floatable units connected together by a cable system which maintains them relatively immobile relative to each other. They are not angularly movable relative to each other. One object of the duct is to carry electric cables and telephone lines. The units are connected with post-tensioned cables with commonly known locking devices.

SUMMARY OF THE INVENTION

A floatable and sinkable concrete structure for making a wharf made of at least one shell having a hollow inner chamber lined with an air impermeable material for allowing the shell to float on water. The shell has an aperture through two opposite walls and near the upper part of these opposite walls. A duct extends between one of the apertures and the bottom of the chamber. Plug means are removably installed in the free apertures to prevent the water from entering the chamber. The shell is sank by removing the plug means and by sucking air from the chamber through the aperture without a duct whereby the water enters the chamber through the duct. The shell is refloated by reversing the air circulation, i.e. by air pressure exerted in the chamber through the aperture without a duct to push the water out of the chamber through the duct.

DETAILED DESCRIPTION OF THE INVENTION

Figure 1:
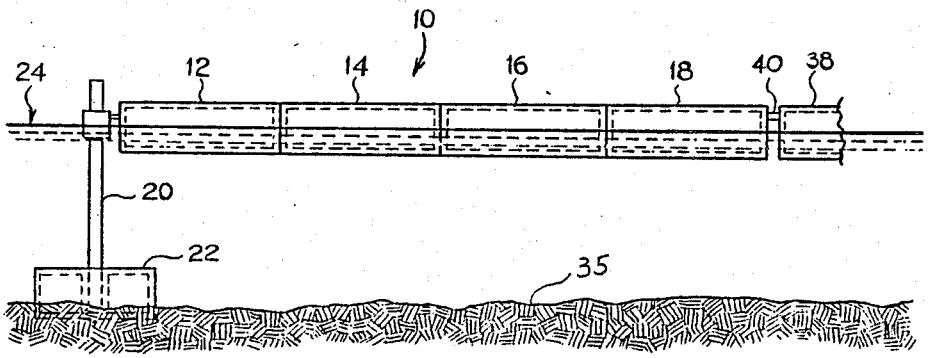
FIG. 1 is a schematic view of a floating wharf anchored to a post according to the invention.
Figure 2:
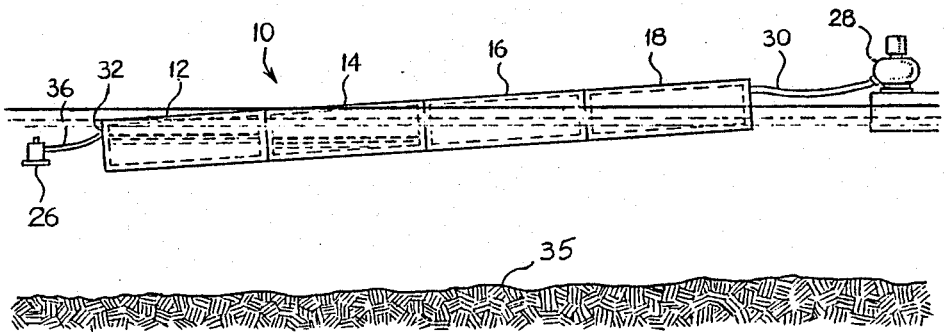
FIG. 2 is a schematic view of wharf during the sinking procedure.
Figure 3:
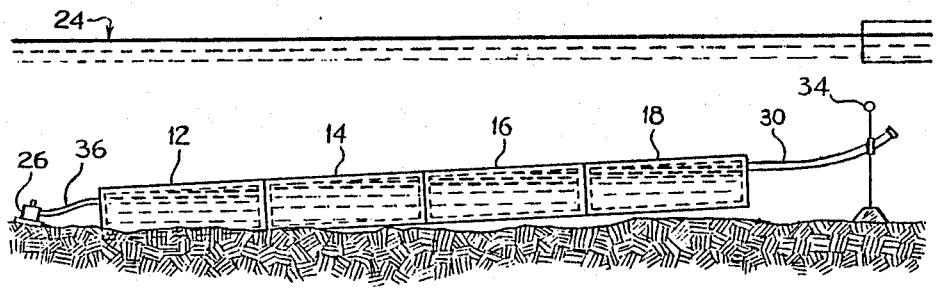
FIG. 3 is a schematic view of a wharf resting on the shore bed.

The floating wharf structure, according to the invention, is illustrated in FIGS. 1, 2 and 3 at three different stages of its floating and sinking procedure. In FIG. 1, the modular structure 10 is made of 4 adjacent shells 12, 14, 16 and 18 connected to each other. The end shell 12 is slidably connected to a post 20 which is fixed to an anchor 22. The shells 12, 14, 16 and 18 have an inner air tight chamber which allows the structure 10 to float on the surface 24 of the water. When the modular structure 10, forming the wharf, is not to be used during the off-season or before a storm, it is disconnected from the post 20 and connected to a sinkable anchor 26 through a connecting line 36. A reversable low air pressure blower 28 is connected through a line 30, to the inner air chambers of the shells 12, 14, 16 and 18 and to the anchor 26. As the air is pulled out of the anchor 26 and the shells, the anchor 26 and shell 12 will start to be subsequently filled with water. The anchor 26 is connected to aperture 32 located near the upper part of the shell 12 will start to sink slowly. As the air evacuate successively shells 12, 14, 16 and 18, water will fill the latter and will cause the progressive sinking of the complete modular structure 10. When the inner chambers of all the shells 12–18 are filled with water, the modular structure sinks to the bottom of the shore below the water level 24. At that stage, the last shell 18 may be connected to a retractable manual anchor 34 which is dropped to the bottom of the shore for holding the line 30. As illustrated in FIGS. 2 and 3, the front aperture 32 of the shell 12 is connected to the sinking and floating anchor 26 which is provided with an inner air chamber from which the connecting line 36 can push or withdraw air therefrom.

It is ussually preferred not to completely filled the last shell, such as 18 with water, to prevent the structure 10 from sinking on its total lenth, as shown in FIG. 3. Such prevention facilitates the lifting of anchor 34 and the structure 10 from the bed of the shore 35.

As explained latter, the modular structure 10 may be connected to another similar modular structure 38 by a hinge arrangement 40.

A positive air pressure differential allows the entrance and the removal of air in the communicating chambers in each of the shells of the modular structure. A negative air pressure allows the water to enter in the first chamber of shell 12 and, as explained in detail later, when the first shell 12 is filled, overflow will subsequently enter the second shell 14. This procedure will continue till it reaches the last shell 18. A positive pressure from the blower 28 will reverse the procedure and evacuate water from the shells starting from the last shell 18.

When the wharf is in its normally floating position, the aperture 32 lies above the level of the water 24 and could not, normally, let the water enter the shell 12. Furthermore, as explained latter, the aperture 32 is provided with a sealing plug to prevent the water from entering the shell 12. However, when the sinking operation needs to be performed, the shell 12 is freed from the post 20 and the aperture 32 is hydraulically connected to the anchor 20 which acts as a water filter partially submerged into the water. When suction starts to be exerted from the reversable air pressure blower 28, the air starts to be sucked out of the filter 26 which sinks slowly and allows the water into flow to the shell 12.

The modular structure 10 shown in FIG. 1, comprises four shells 12–18. The wharf may be made of a plurality of modular structures as identified by structures 10 and 38 connected by a linkage 40, described latter, which allows an angular motion relative to the horizontal between the two structures 10 and 38.

Figure 4:
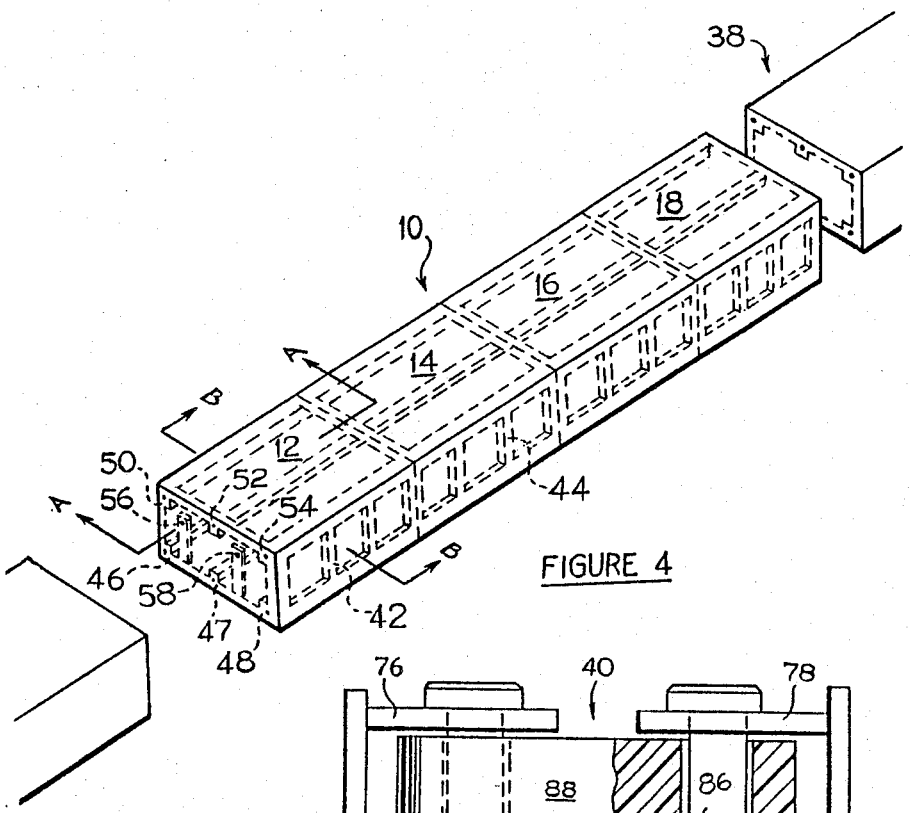
FIG. 4 is a schematic view of a modular structure for forming a wharf.
Figure 5:
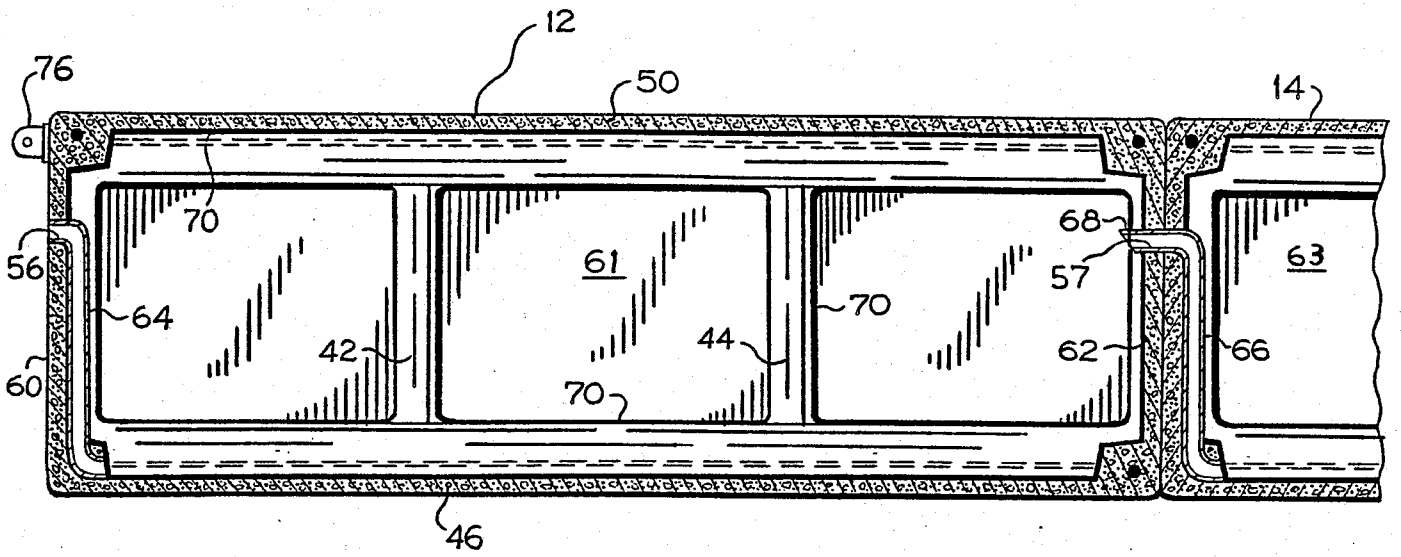
FIG. 5 is a cross-sectional view taken along line A—A of FIG. 4.
Figure 6:
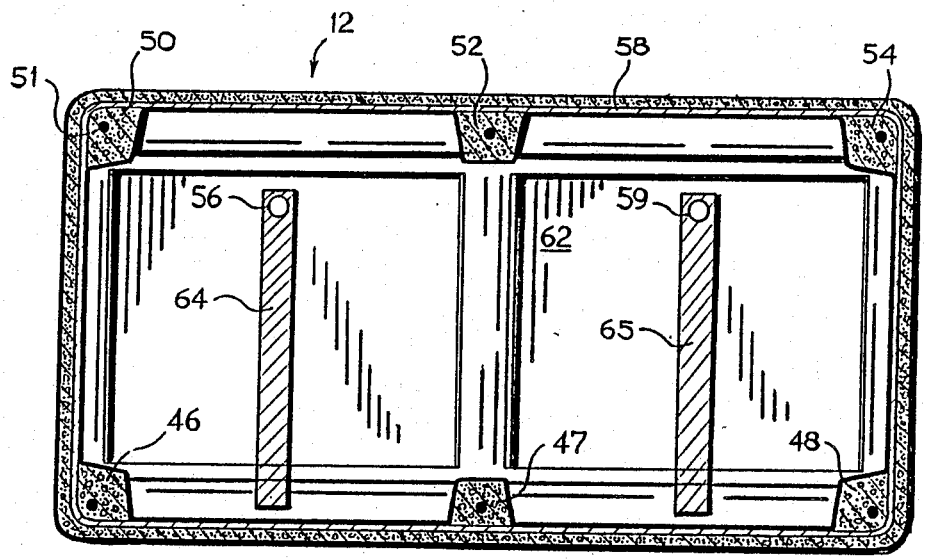
FIG. 6 is a cross-sectional view taken along line B—B of FIG. 4.

FIG. 4 is a schematic view of the modular structure 10 made of the adjacent shells 12–18. Each shell such as 12 is made of vertical reinforcing beams 42 and 44 and horizontal reinforcing beams 46, 47 and 48 extending along the lower surface of the shell and three other horizontal reinforcing beams 50, 52 and 54 disposed along the internal upper surface of the shell. The lower beam 47 longitudinally extends along the central axis of the shell to allow the water entering inside the shell through the apertures 56 and 58 to be spread more evenly on the bottom of the latter to prevent the shell from tipping sideways. Shell 12 which is described in greater detail in FIG. 5 is a cross-sectional view along line A—A of FIG. 4. The same shell 12 is illustrated in FIG. 6 as a cross-sectional view along line B—B of FIG. 4. The shell is a monolith concrete cast surrounding all the walls of the shell and reinforced by longitudinal concrete beams 46, 47, 48, 50, 52 and 54. To provide a rigid concrete construction, the beams are reinforced with imbedded high tension steel cables prestressed or stressed according to known stressing practices. The vertical sidewalls of the shells such as 12 are provided with a few vertical reinforcing beams such as 42 and 44 extending between the lateral lower and upper beams 46–50 and 48–54. A reinforcing steel belt 58 as shown in FIG. 6 is imbedded in the peripheral concrete wall of the shell such as 12. At both ends of the shell, the end walls 60 and 62 are respectively provided with an aperture 56 and 57 located at the upper level of the shell. A duct 64 extends from the aperture 56 down to the bottom of the inner chamber inside the shell. The purpose of the duct 64 is to bring the water which enters the aperture 56 down to the level of the bottom of the chamber 61 and to allow the water which lies at the bottom of the shell to exit through the duct 64 and out of the aperture 56. This piping construction is particularly suitable for moving the water from one shell to the other such as shown in FIG. 5 from shell 14 to shell 12. The water which lies in the chamber 63 inside the shell 14, will, upon air pressure in the chamber 63, be pushed upwardly into the duct 66 into the overflow pipe 68 and inside the chamber 62. The same structure and the same operation will be performed for moving the water from shell 18 to 16 to 14 and to 12.

In order to maintain each monolith concrete shell from tipping sideways, two apertures such as 56 and 59 (FIG. 6) on each side of the central lower beam 47 so that the weight of water can be spread more evenly on the lower surface of the inner chamber 61 till beam 47 is submerged. The aperture 59 extends down the bottom of the chamber through a duct 65 similar to the duct 64. The inner surface of the shell is completely covered or coated with a plastic lining so as to make the chamber 62 fully airtight when the apertures 56 and 57 are closed. Concrete may be sufficient to make the inner chamber 61 airtight but a plastic lining is preferred so as to maintain the seal under more adverse conditions even if the concrete is slightly cracked. Although, the method for constructing the shell is not part of this invention, the latter is preferably constructed by starting with a plastic hollow, slightly pressurized body having the shape of the inner chamber 62 around which the concrete is blasted to form the monolith concrete shell. Preferably, the four adjacent shells 12–18, are mounted together with steel cables such as 51 extending along the four shells and over which the concrete is blasted for forming a complete modular structure such as 10.

Although, the shell shown in FIG. 5 has been described as being longitudinally divided in two equal parts by the three longitudinal beams, the shell can be divided in more than two parts as long as the shell can remain equally balanced on both sides of its central longitudinal axis.

Figure 8:
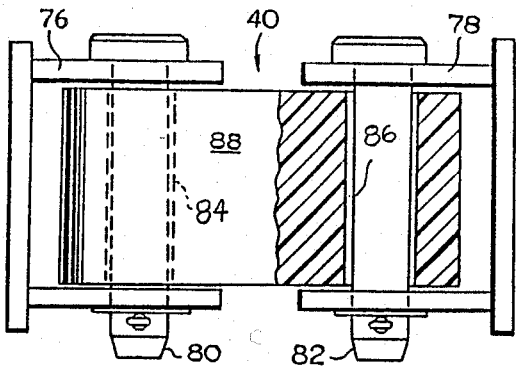
FIGS. 8 and 9 are a top and side views of a flexible link for connecting shells.
Figure 9:
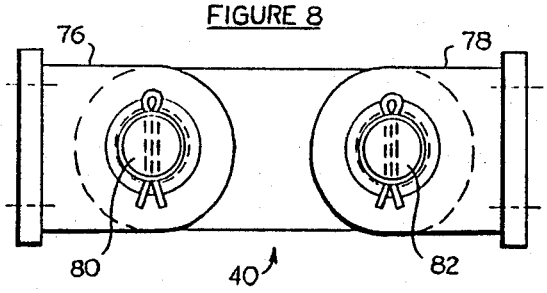
Figure 7:
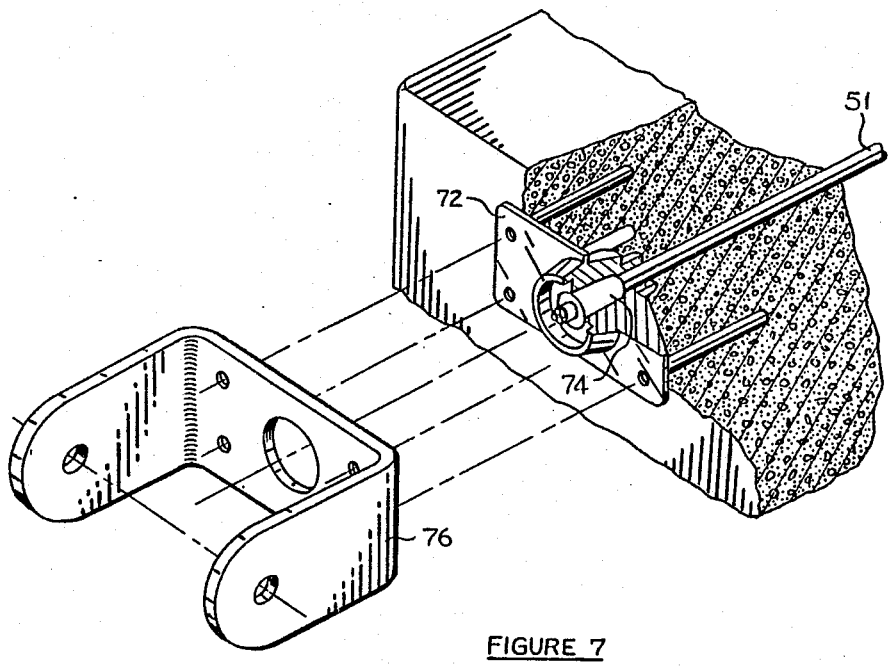
FIG. 7 is an exploded view of a yoke and a plate for mounting a connecting link.
Figure 11:
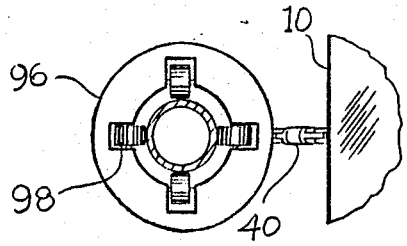
FIG. 11 is a top view of a floating anchor as shown in FIG. 10.

The front part of the shell such as 12 illustrated in FIG. 5 is mounted with a pair of yokes 76 as more specifically described in FIG. 7. The imbedded steel cable 51 is held by a steel plate 72 abutting against the front surface of the shell through a reinforced taper lock 74. The plate 72 is used to fasten the yoke 76 as stated earlier, for FIG. 1, two adjacent modular structure such as 10 and 38 are each provided with a yoke such as 76 to form a linkage arrangement 40 shown in FIG. 1 and described more in details in FIGS. 8 and 9. Two adjacent yokes 76 and 78 are each supporting pins 80, 82 and bushings 84 and 86 respectively. A reinforced flexible strap 88 such as reinforced rubber surrounds both bushings 84 and 86 to provide a flexible link between two adjacent shells. A pair of links such as 40 are disposed on each side of the shell relative to the central axis to maintain the parallelism between two adjacent shells.

Figure 10:
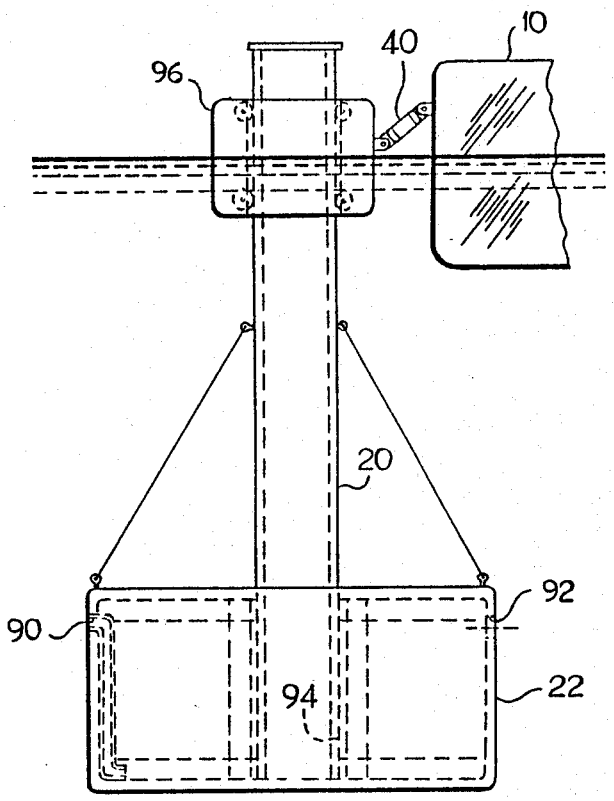
FIG. 10 is a side view of a vertically sliding anchoring arrangement for wharf.

The anchor 22 and the post 20 shown in FIG. 1 are more completely illustrated in FIG. 10. To extend the benefit of the present invention, the anchor 22 is constructed as a monolith concrete shell lined with plastic and provided with a pair of apertures 90 and 92 so as to be able to sink and refloat the anchor 22 in a somewhat similar manner as the shell 12 previously described. The anchor 22 is provided with a central vertical channel 94 to receive and secure the post 20. A floating anchor 96 made of buoyant material or having a buoyancy lighter than water is slidably mounted around the post 20 with rollers 98 disposed around the post 20. A connecting link 40 such as described above or an other suitable hinge is used to secure the modular structure 10 to the floating anchor 96.

Known low air pressure blowers being reversible are used as a blower 28 shown in FIG. 2. A blower having a maximum capacity of about four pounds is sufficient to create the floating and sinking operation.

The plastic used as a liner for the inner chambers may be any suitable airtight plastic material such as polyethylene or fiberglass. When the wharf is installed to remain in its floating position such as FIG. 1, a sealing plug may be used to close the aperture 56 at one end of the modular structure and another plug in the aperture 57 at the other end.

It should be understood that each modular structure may be made of at least two shells and preferably four or five shells. In the case of four adjacent shells, such shells have been contemplated and made with the following approximative dimensions:

length: 300 cm
width: 200 cm
heigh: 100 cm with surrounding walls having a thickness of about 3.8 centimeters reinforced with beams of about 11 to 14 centimeters in cross-section. The shells are made of good quality Portland cement or including polymer with fiber aggregates or light aggregates having high resistance are suitable for the present invention and provide a suitable buoyancy.

I claim:

1. A floatable and sinkable concrete modular structure for making a wharf comprising a hollow parallelepipedic shell having an inner chamber, said shell being made of a rigid layer of reinforced concrete lined with an inner layer of an air impermeable material forming the surrounding walls of said chamber having opposite end walls, the size of said chamber being sufficiently large to allow the buoyancy of the shell in water when the chamber is filled with air, at least one pair of apertures through said one shell located at the upper part of said shell, said first and second apertures being located on opposite end walls, a duct located inside said shell extending between said first aperture located and the lower part of said chamber, whereby an inflow of water in said chamber through said first apertures allows the concrete modular structure to sink when floating in water and to refloat when air pressure is projected inside said chamber through said second apertures for ejecting the water located inside the chamber through said duct and through said first apertures.

2. A floatable and sinkable concrete modular structure as recited in claim 1, wherein the shell has an upper and lower wall comprising a plurality of parallel longitudinal concrete beams projecting inside the chamber for equally subdividing the said upper and lower walls, a tension cable imbedded in each of said beams, and reinforcing steel wires imbedded in the layer of concrete around cross-sectional planes of the shell.

3. A floatable and sinkable concrete modular structure as recited in claim 2, wherein the plurality of beams comprises a central and two lateral beams equally bisecting the upper and lower walls.

4. A floatable and sinkable modular structure as recited in claim 2, wherein a pair of said first and second apertures and said ducts is located between each of said beams, wherein the inflow of water is allowed to enter the pair of said first apertures and air pressure is adapted to be protected in the pair of said second apertures.

5. A wharf made of plurality of shells as recited in claim 2, said shells being consecutively and longitudinally aligned in the direction of the longitudinal beams and rigidly secured to one another, hydraulic communicating means between the second apertures of the shells and the first apertures of the consecutive shell, linking means for connecting each of said corresponding tension cables of adjacent plurality of shells, said linking means being flexible for allowing an angular movement between said adjacent plurality of shells.

6. A floatable and sinkable concrete modular structure as recited in claim 5, wherein each of said linking means comprises two U-shaped yoke members, each of said yoke members being secured to said adjacent end walls of said plurality of shells, a transversal pin mounted across each of said yoke member and an elastic strap member for spacedly connecting said pins.

7. A floatable and sinkable concrete modular structure as recited fin claim 4, wherein each shell is provided with a pair of apertures through each of said opposite end walls, a pair of duct located inside said shell extending between the apertures located through one of said opposite end walls and the lower part of said shell, each of said pair of apertures and said ducts being located between adjacent longitudinal beams of said concrete beams, whereby the inflow of water between adjacent beams remains between the same adjacent beams till the said beams are submerged.

8. A floatable and sinkable wharf comprising a plurality of consecutively mounted hollow shells, each of said shells having an internal chamber for receiving a liquid, said plurality of shells having a first and last shell.

hydraulically communicating means between the upper part of the chamber of said shells with the bottom part of the chamber of the consecutive shell for successively filling said chambers with said liquid entering through an aperture in the upper part of said first shell;

pneumatic means adapted to be connected to an aperture in the upper part of said last shell for circulating air through said hydraulic communicating means from said bottom part to said upper part for, at least partly, eliminating said liquid from said cavities through said aperture in said first shell, whereby said wharf sinks when said chambers are filled with said liquid and refloat when the liquid is eliminated from said chambers.

9. A method for sinking and refloating a wharf made of a plurality of consecutively mounted hollow shells, each shell having an internal chamber for reciving liquid, said plurality of shells having a first and last shell, each of said first and last shell having an aperture adjacent the top thereof, said method comprises:

hydraulically communicating the top of the chamber of said shells with the bottom of the chamber of the consecutive shell for successively filling said chambers with said liquid entering through said aperture in said first shell;

pneumatically connecting through said aperture in said last shell, said chambers from said bottom of the chambers to said top of the successive chambers for consecutively eliminating, at least in part, said liquid from said chambers through said aperture in said first shell, whereby said wharf sinks when said chambers are filled with said liquid and refloat when the liquid is eliminated from said chambers.

* * * * *